US007356951B2

(12) United States Patent
Spielberger et al.

(10) Patent No.: US 7,356,951 B2
(45) Date of Patent: Apr. 15, 2008

(54) INFLATABLE DANCING TOY WITH MUSIC

(75) Inventors: Lee Spielberger, Warwick, RI (US); Douglas Arthur Schultheis, Cumberland, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 11/032,912

(22) Filed: Jan. 11, 2005

(65) Prior Publication Data

US 2006/0150451 A1 Jul. 13, 2006

(51) Int. Cl.
*G09F 19/08* (2006.01)

(52) U.S. Cl. ..... 40/412; 40/439; 40/457; 446/178; 446/199

(58) Field of Classification Search ..... 40/610, 40/455, 457, 439, 477, 412, 538; 446/178, 446/199, 220

See application file for complete search history.

(56) References Cited

U.S. PATENT DOCUMENTS 2,047,377 A * 7/1936 Liwschutz ..... 40/455
2,065,473 A * 12/1936 Liwschutz ..... 40/412
2,348,250 A * 5/1944 Gardner et al. ..... 40/411
2,487,546 A * 11/1949 Harrowe ..... 446/189
2,633,665 A * 4/1953 Kwasnik et al. ..... 446/186
2,748,256 A * 5/1956 Moran ..... 362/362
3,159,935 A * 12/1964 Rubens ..... 40/415
3,563,676 A * 2/1971 Coovert et al. ..... 417/410.1
3,670,440 A * 6/1972 Yost ..... 40/215
3,721,039 A * 3/1973 Cook et al. ..... 446/178
3,740,893 A * 6/1973 Shinoda ..... 446/198
3,855,729 A * 12/1974 Sapkus et al. ..... 446/185
4,020,786 A * 5/1977 Kopeika ..... 116/210
4,034,501 A * 7/1977 Zeyra ..... 446/224
4,075,782 A * 2/1978 Neuschatz ..... 446/295
4,223,474 A * 9/1980 Strauss ..... 446/221
4,253,659 A * 3/1981 Fattler ..... 472/101
4,271,620 A * 6/1981 Vicino et al. ..... 40/406
4,369,591 A * 1/1983 Vicino ..... 40/610
4,416,073 A * 11/1983 Vicino et al. ..... 40/326
4,447,974 A * 5/1984 Vicino et al. ..... 40/538
4,765,079 A * 8/1988 Takahashi ..... 40/439
4,784,628 A * 11/1988 McArdle et al. ..... 446/225
4,820,231 A * 4/1989 Mikitka et al. ..... 40/538
4,837,958 A * 6/1989 Radovich ..... 40/538
4,863,411 A * 9/1989 Brown ..... 446/27

(Continued)

OTHER PUBLICATIONS

"3D Dog Bop Bag" http://www.superdairy.com/Toys/Bop_Bags/Dog.htm.*

*Primary Examiner*—William L. Miller
(74) *Attorney, Agent, or Firm*—Marshall, Gerstein & Borun LLP

(57) ABSTRACT

An inflatable toy may include a housing, a balloon-like structure, a blower mechanism, a drive mechanism, and a motor. The balloon-like structure may include a base, an inflatable portion, and an inlet. The base and the inflatable portion may define an air storage area. The blower mechanism may be fluidly connected to the inlet of the balloon-like structure, and the drive mechanism may be operatively connected to the base. The motor may be operatively connected to the blower mechanism and the drive mechanism, wherein upon activation of the motor the blower mechanism may inflate the balloon-like structure and the drive mechanism may cause the balloon-like structure to move.

23 Claims, 8 Drawing Sheets

U.S. PATENT DOCUMENTS 4,898,561 A * 2/1990 Nottingham et al. ..... 446/220
4,913,676 A * 4/1990 Koguchi et al. ..... 446/300
4,920,674 A * 5/1990 Shaeffer ..... 40/412
5,083,771 A * 1/1992 Tyner ..... 472/54
5,104,346 A * 4/1992 Smrt ..... 446/199
5,108,337 A * 4/1992 Sloan et al. ..... 446/220
5,115,472 A * 5/1992 Park et al. ..... 381/152
5,125,177 A * 6/1992 Colting ..... 40/610
5,149,015 A * 9/1992 Davis ..... 244/31
5,152,092 A * 10/1992 O'Brien ..... 40/610
5,186,675 A * 2/1993 D. Stoddard ..... 446/199
5,196,242 A * 3/1993 Vicino ..... 428/12
5,205,774 A * 4/1993 Smrt ..... 446/199
5,234,726 A * 8/1993 Dahan ..... 428/9
5,240,449 A * 8/1993 Sloan et al. ..... 446/220
5,250,002 A * 10/1993 Kinberg ..... 446/220
5,279,514 A * 1/1994 Lacombe et al. ..... 446/297
5,293,707 A * 3/1994 Shaeffer ..... 40/412
5,316,516 A * 5/1994 Saitoh ..... 446/175
5,335,436 A * 8/1994 Gurr ..... 40/412
5,367,294 A * 11/1994 Brown ..... 340/692
5,370,569 A * 12/1994 Mo-Hsin ..... 446/175
5,378,188 A * 1/1995 Clark ..... 446/330
5,389,030 A * 2/1995 Chapkis ..... 446/397
5,402,591 A * 4/1995 Lee ..... 40/610
5,467,543 A * 11/1995 Fink et al. ..... 40/538
5,522,756 A * 6/1996 Barthold ..... 446/193
5,566,491 A * 10/1996 Phillips ..... 43/3
5,579,813 A * 12/1996 Watts ..... 141/317
5,647,809 A * 7/1997 Yip ..... 473/594
5,662,510 A * 9/1997 Wolens ..... 446/397
5,710,543 A * 1/1998 Moore ..... 340/691.7
5,735,726 A 4/1998 Cohen
5,778,581 A * 7/1998 Bailey ..... 40/610
5,791,077 A * 8/1998 Felber ..... 40/610
5,852,889 A * 12/1998 Rinaldi ..... 40/124.06
6,017,261 A * 1/2000 Wachtel ..... 446/301
6,052,067 A * 4/2000 Nuxoll ..... 340/908
6,075,195 A * 6/2000 Gabai et al. ..... 84/645
6,089,948 A * 7/2000 LaBarbara et al. ..... 446/318
6,135,846 A * 10/2000 Young ..... 446/302
6,135,848 A * 10/2000 Hou ..... 446/353
6,148,551 A * 11/2000 Glass ..... 40/214
6,155,837 A * 12/2000 Korneliussen ..... 434/226
6,168,160 B1 * 1/2001 DeOreo et al. ..... 273/374
6,186,857 B1 * 2/2001 Gazit et al. ..... 446/226
6,240,666 B1 * 6/2001 Apel et al. ..... 40/610
6,279,254 B1 * 8/2001 Gill et al. ..... 40/439
6,296,543 B1 * 10/2001 Andrews ..... 446/334
6,302,171 B1 * 10/2001 Watts ..... 141/317
6,347,470 B1 * 2/2002 Radovich ..... 40/610
6,350,170 B1 * 2/2002 Liu ..... 446/353
6,373,384 B1 * 4/2002 Ferguson et al. ..... 340/540
6,394,872 B1 * 5/2002 Watanabe et al. ..... 446/175
6,428,185 B1 * 8/2002 Lin ..... 362/253
6,435,688 B1 * 8/2002 Pittman ..... 362/34
6,439,950 B1 * 8/2002 Goldman et al. ..... 446/220
6,447,361 B1 * 9/2002 Akiyama ..... 446/226
6,478,651 B1 * 11/2002 Weir ..... 446/220
6,482,065 B1 * 11/2002 Blackman ..... 446/220
6,537,128 B1 3/2003 Hampton et al.
6,565,407 B1 * 5/2003 Woolington et al. ..... 446/175
6,609,945 B2 * 8/2003 Jimenez et al. ..... 446/454
6,644,843 B2 * 11/2003 Chin-Cheng ..... 362/97
6,668,475 B2 * 12/2003 Carolan ..... 40/610
6,699,098 B1 * 3/2004 Kau ..... 446/298
6,722,084 B2 * 4/2004 Berman ..... 52/2.11
6,764,201 B2 * 7/2004 Chi-Cheng ..... 362/352
6,786,793 B1 * 9/2004 Wang ..... 446/226
6,804,905 B1 * 10/2004 Burger et al. ..... 40/610
6,843,655 B1 * 1/2005 Duprey ..... 434/133
6,892,772 B1 * 5/2005 Wang et al. ..... 141/313
6,926,580 B1 * 8/2005 Wang ..... 446/299
6,991,511 B2 * 1/2006 Maggiore et al. ..... 446/330
2001/0029147 A1 * 10/2001 Hornsby et al. ..... 446/356
2001/0034176 A1 * 10/2001 Deliu ..... 446/26
2002/0094746 A1 * 7/2002 Harlev ..... 446/178
2002/0106966 A1 * 8/2002 Jimenez et al. ..... 446/454
2002/0116849 A1 * 8/2002 Carolan ..... 40/610
2003/0013375 A1 * 1/2003 Austin ..... 446/224
2003/0181126 A1 * 9/2003 Blackman ..... 446/220
2004/0116039 A1 * 6/2004 Mueller et al. ..... 446/220
2004/0198148 A1 * 10/2004 Pittman ..... 446/220
2004/0211100 A1 * 10/2004 Scherba ..... 40/610

* cited by examiner

INFLATABLE DANCING TOY WITH MUSIC

TECHNICAL FIELD

The present disclosure relates generally to inflatable toys and, more particularly, to inflatable toys having automated movements that correspond to music and a method of using the same.

BACKGROUND OF THE DISCLOSURE

Inflatable toys and toys having automated movements are known in the art. For example, U.S. Pat. No. 4,920,674 discloses a self-inflatable balloon that includes a communication on its surface. The balloon has its mouth opening pneumatically sealed to a funnel through which air is selectively directed upon actuation of a triggering event. An audible communication may also be actuated by the same or a different triggering event. A method of communicating may include a message which becomes cognizable upon inflation of a message carrying device.

In another example, U.S. Pat. No. 4,913,676 discloses a moving animal toy having an upper beak and a lower beak that are connected to a motor, such that upon activation of the motor the upper and lower beaks are pivoted up and down simultaneously to widely open and close the beaks. At the same time a head of the animal toy may slowly rotated twisting its head sideways. When a voice is uttered against the toy, it is received through a microphone by a voice recording and reproducing device and after a specified recording time elapses, the voice is reproduced by a speaker.

In another example, U.S. Pat. No. 6,699,098 discloses an animated musical alligator which features movement while playing music. When it plays songs, mouth movements occur in synchronization with the singing, as a result of its circuitry and mechanical operation system. In addition, the alligator produces realistic walking movements and up-and-down, as well as side-to-side head movements: The animated musical alligator's integrated circuit, which creates sound signal and movement signal outputs, produces music through its amplifier and speaker. Additionally, the integrated circuit activates various motors that trigger gears to create leg movements and side-to-side and up-and-down head movements. This operation system also creates mouth movements in synchronization with the playing of songs.

SUMMARY OF THE DISCLOSURE

In accordance with one aspect of the disclosure, an inflatable toy is disclosed. The inflatable toy includes a housing, a balloon-like structure, a blower mechanism, a drive mechanism, and a motor. The balloon-like structure includes a base, an inflatable portion, and an inlet. The base and the inflatable portion define an air storage area. The blower mechanism is fluidly connected to the inlet of the balloon-like structure, and the drive mechanism is operatively connected to the base. The motor is operatively connected to the blower mechanism and the drive mechanism. The blower mechanism inflates the balloon-like structure and the drive mechanism to cause the balloon-like structure to move when the motor is activated.

In accordance with another aspect of the disclosure, an inflatable toy is disclosed. The inflatable toy includes a housing, a balloon-like structure, a drive mechanism, a controller, an audio output, and a motor. The balloon-like structure includes a base, an inflatable portion, and an inlet. The base is pivotally attached to the housing. The drive mechanism is operatively connected to the base, and the motor is operatively connected to the drive mechanism. The controller is communicably coupled to the motor and the audio output, and is configured to correspond the movement of the balloon-like structure with music from the audio output.

In accordance with another aspect of the disclosure, a method of operating an inflatable toy is disclosed. The method includes providing a balloon-like structure having a base, an inflatable portion, and an inlet, and providing a blower mechanism that is fluidly connected to the inlet of the balloon-like structure. The method further includes providing a drive mechanism operatively connected to the base, and activating a motor operatively connected to the blower mechanism and the drive mechanism.

In accordance with another aspect of the disclosure, an inflatable toy is disclosed. The inflatable toy includes a balloon-like structure having an inflatable portion, and an inlet, and a means for inflating the balloon-like structure. The inflatable toy further includes a means for moving the balloon-like structure, and a motor that provides the power to both inflate and move the balloon-like structure.

These and other aspects and features of the disclosure will be more readily understood upon reading the following detailed description when taken in conjunction with the accompanying drawings.

DETAILED DESCRIPTION

Although the following text sets forth a detailed description of numerous different embodiments of the invention, it should be understood that the legal scope of the invention is defined by the words of the claims set forth in the appended claims. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

Figure 1:
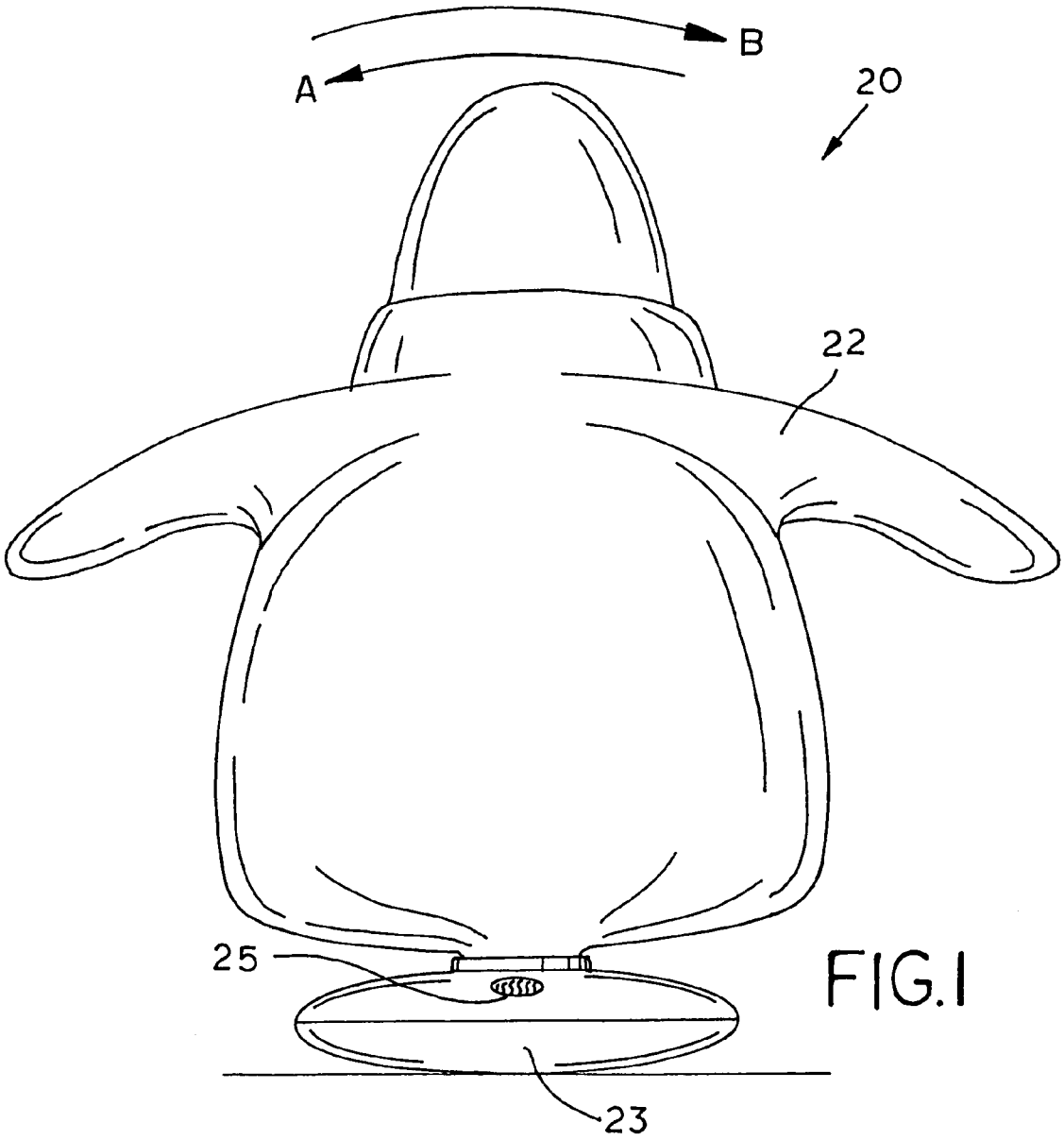
FIG. 1 is an isometric view of an inflatable toy according to one embodiment of the disclosure.

Referring now to the drawings and with specific reference to FIG. 1, an inflatable toy constructed in accordance with the teachings of the disclosure is generally depicted by reference numeral 20. As shown therein, the inflatable toy 20, in this exemplary embodiment, includes a balloon-like structure 22 and a housing 23. The inflatable toy 20, as disclosed herein, is intended to provide entertainment for children using one or more methods of stimulation, such as for example visual, audio, etc. During operation, the balloon-like structure 22, while inflated, may move in a back and forth motion, as indicated by arrows A and B, as the inflatable toy 20 simultaneously provides music or other audible stimulation via a speaker 25, or the like. Additionally, the movement of the balloon-like structure 22 may correspond or coincide with the music.

Figure 2:
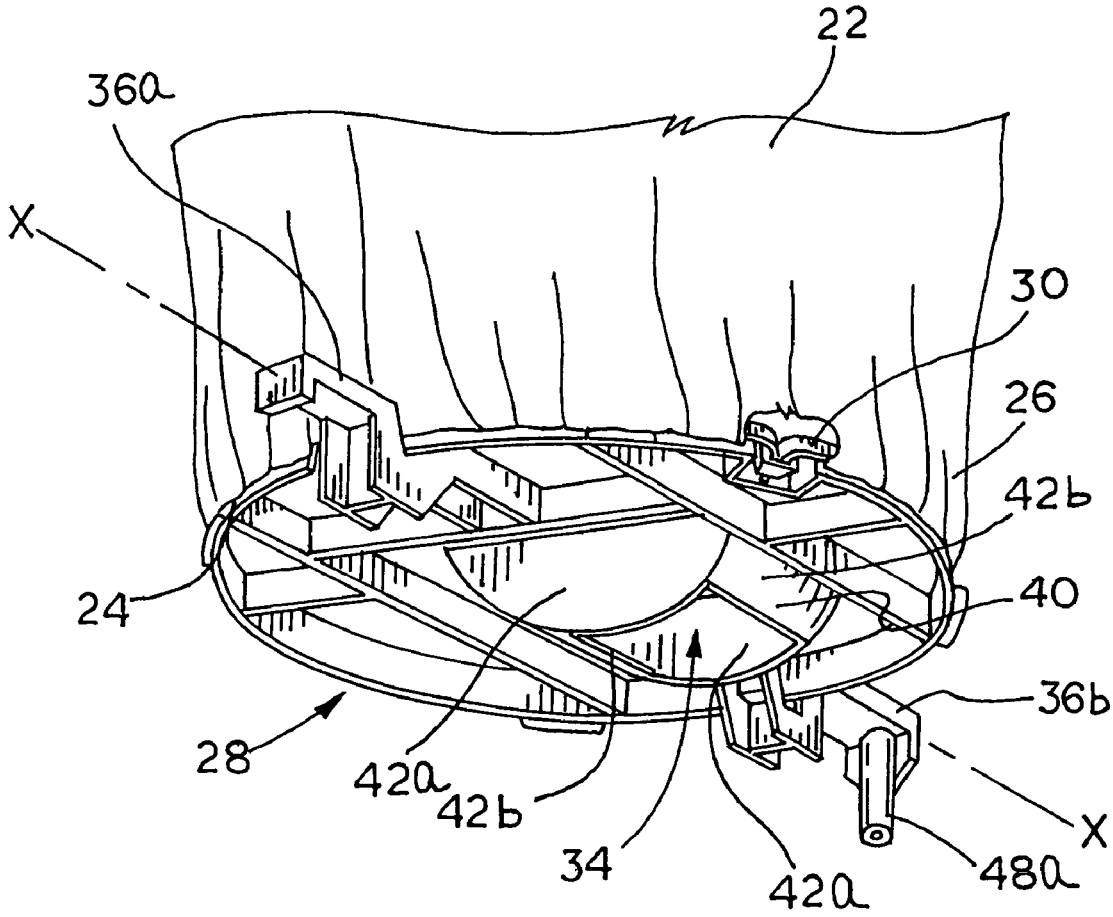
FIG. 2 is a bottom view of a base and balloon-like structure of the inflatable toy of FIG. 1 with the housing removed.

The balloon-like structure 22, as seen in FIGS. 1 and 2, may be constructed from a plastic, elastic, or other latex material, and able to contain air so as to obtain an inflatable balloon-like structure 22. The material of the balloon-like structure 22 may, however, be constructed from a tightly woven material, such as nylon, cotton, and the like. The balloon-like structure 22 may also come in many shapes and sizes, and may be designed to resemble, represent, or emulate certain types of people, creatures, or characters either real or imaginary. In this exemplary embodiment, the balloon-like structure 22 is a children's character called a Boohbah® (FIG. 1). With reference to FIG. 2, the balloon-like structure 22 may include an opening 24 disposed near a bottom 26 of the balloon-like structure 22, and may be removably attached to a base 28. More specifically, the opening 24 may include an elastic or other resilient member 30 connected to and disposed around a periphery of the opening 24, such that the opening 24 of the balloon-like structure 22 may fit onto the base 28, thereby connect the balloon-like structure 22 to the base 28. Additionally and/or alternatively, the balloon-like structure 22 may be connected to the base 28 via one or more fasteners, such as screws, glue, clips, bolts, adhesive, and the like.

The base 28, as seen in FIG. 2, may have a generally circular or disk-like shape and may include an aperture 34 and a pair of pivot posts 36*a*, 36*b*. The aperture 34 may be disposed near a center of the base 28 and may have a generally rectangular or square shape. The aperture 34 may be an inlet to the balloon-like structure 22 and/or may be a conduit fluidly disposed between a blower mechanism 38 of a drive assembly (FIGS. 3 and 4) and the balloon-like structure 22. A guide channel or rim 40 may be disposed around a periphery of the aperture 34 and may extend downwardly therefrom.

The rim 40 may include one or more walls 42, depending on the shape of the aperture 34 and the intended movement of the balloon-like structure 22. In this exemplary embodiment, the rim 40 may include a first pair of walls 42*a* disposed perpendicular to a second pair of walls 42*b*. The first pair of walls 42*a* may be disposed perpendicular to an axis X, and may have a convex or semi-circular shape with an outer edge that correspond to an inner surface 44 (FIG. 4) of the blower mechanism 38 described below. The second pair of walls 42*b* may extend parallel to the pivot axis X between walls 42*a*, and may curve inwardly toward each other as they extend away from the base and intersect the outer edges of walls 42*a*. As such, the first pair and second pair of walls 42*a*, 42*b* may, in combination, provide at least a partial structure that enables the base 28 to pivot relative to the blower mechanism 38 such that the blower mechanism 38 remains in fluid communication with the balloon-like structure 20 as the base 40 pivots in a manner described more fully below.

Figure 3:
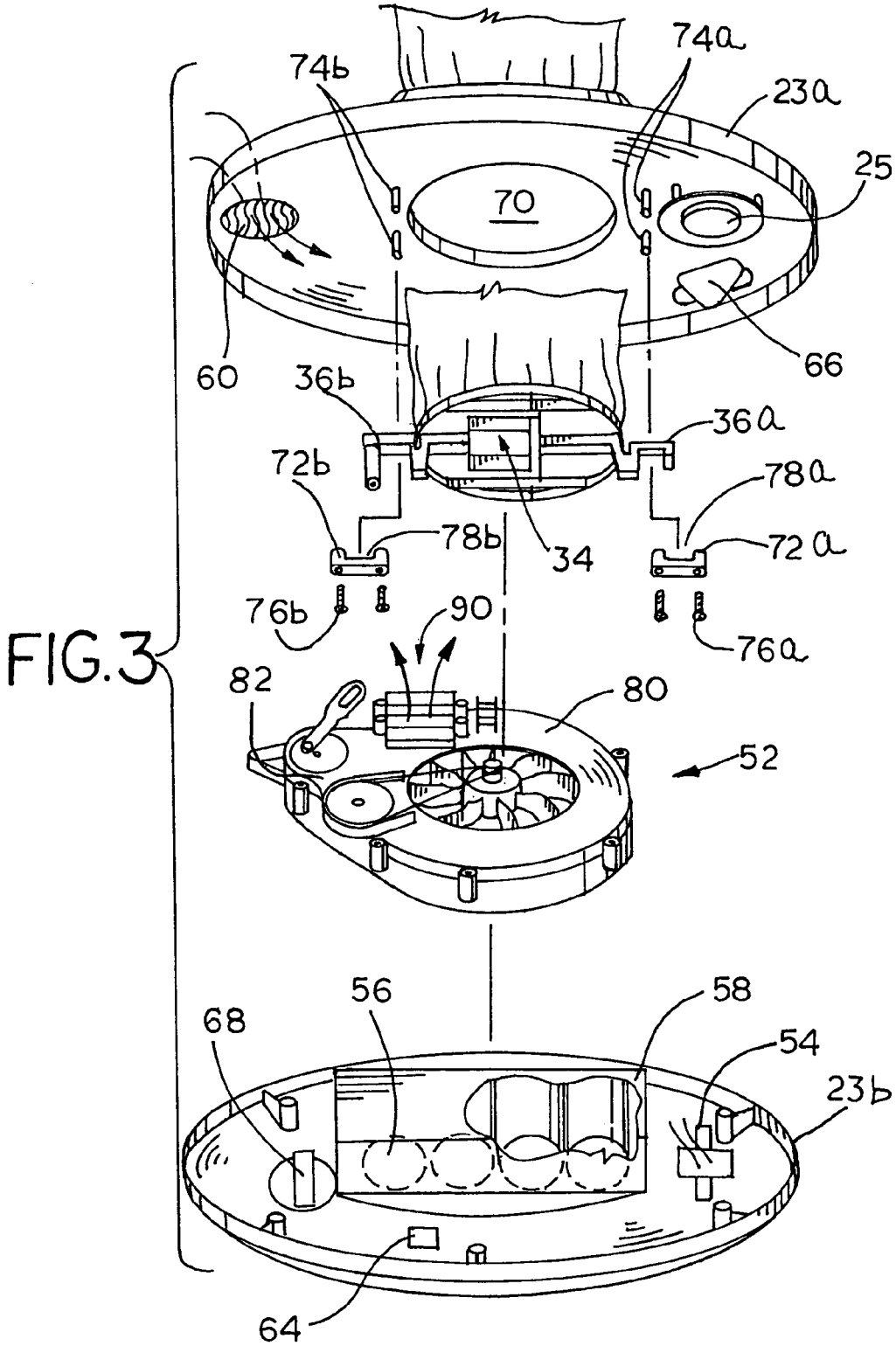
FIG. 3 is an exploded isometric view of a housing of the inflatable toy of FIG. 1.

The pair of post 36*a*, 36*b*, as seen in FIG. 2, may extend radially outward along the axis X from the base 28, and may be adapted to be engaged by a portion of housing 23 to pivot the base 28 about the axis X (FIG. 3). More specifically, each of the pivot posts 36*a*, 36*b* may include an inverted U-shaped portion, as orient in FIG. 2, disposed near an end of the pivot posts 36*a*, 36*b*. Pivot post 36*b* may include a first portion 48*a* of a connection mechanism 48 adapted to connect the base 28 to a drive mechanism 50 (FIG. 6) of the drive assembly in a manner described more fully below. In this exemplary embodiment, the first portion of the connection mechanism 48*a* is an internally threaded cylinder that connects to a second portion of the connection mechanism 48*b* via a fastener, such as a screw or bolt.

The housing 23, as seen in FIG. 3, includes an upper section 23*a* and a lower section 23*b*, that in combination define an area that receives a sub-housing 52, and the remainder of the mechanical and electronic parts for operating the inflatable toy 20, such as, for example the speaker 25, a circuit board 54, a power source 56, a battery compartment 58, a vent 60, a motor 62 (FIGS. 4-6), a power switch 64, a mode switch 66, a selection switch 68, etc. The housing 23 and, more specifically, the upper section 23*a* of the housing, may include an aperture 70 disposed near a center of the upper section 23*a* sized and shaped to receive the base 28. A pair of retaining bars 72*a*, 72*b* may be removably attached to an underside of the upper section 23*a* of the housing and, more particularly, may be attached to the underside adjacent the aperture 70 and may be adapted to engage the plurality of pivot posts 36. For example, as seen in FIG. 3, the retaining bars 72*a*, 72*b* may be attached to a pair of protrusions 74*a*, 74*b* via a pair of fasteners 76*a*, 76*b*, thereby creating a pair of apertures 78*a*, 78*b* for receiving the pair of pivot posts 36*a*, 36*b*, respectively. As a result, the inverted U-shaped portions of the pair of pivot posts 36*a*, 36*b* may rest on the retaining bars 72*a*, 72*b*, with the posts 36*a* and 36*b* being able to displace rotatably within the retaining bars 72*a* and 72*b*, thereby allowing the base 28 to pivot relative to the housing 23 approximately about pivot X. The lower section 23*b* may include structures for mounting various components such as the speaker, the circuit board 54, the power source 56, the battery compartment 58, and/or the selection switch 68. The lower section 23*b* may have a convex or curved bottom such that the housing 23 can rock or wobble relative to a support surface.

Figure 4:
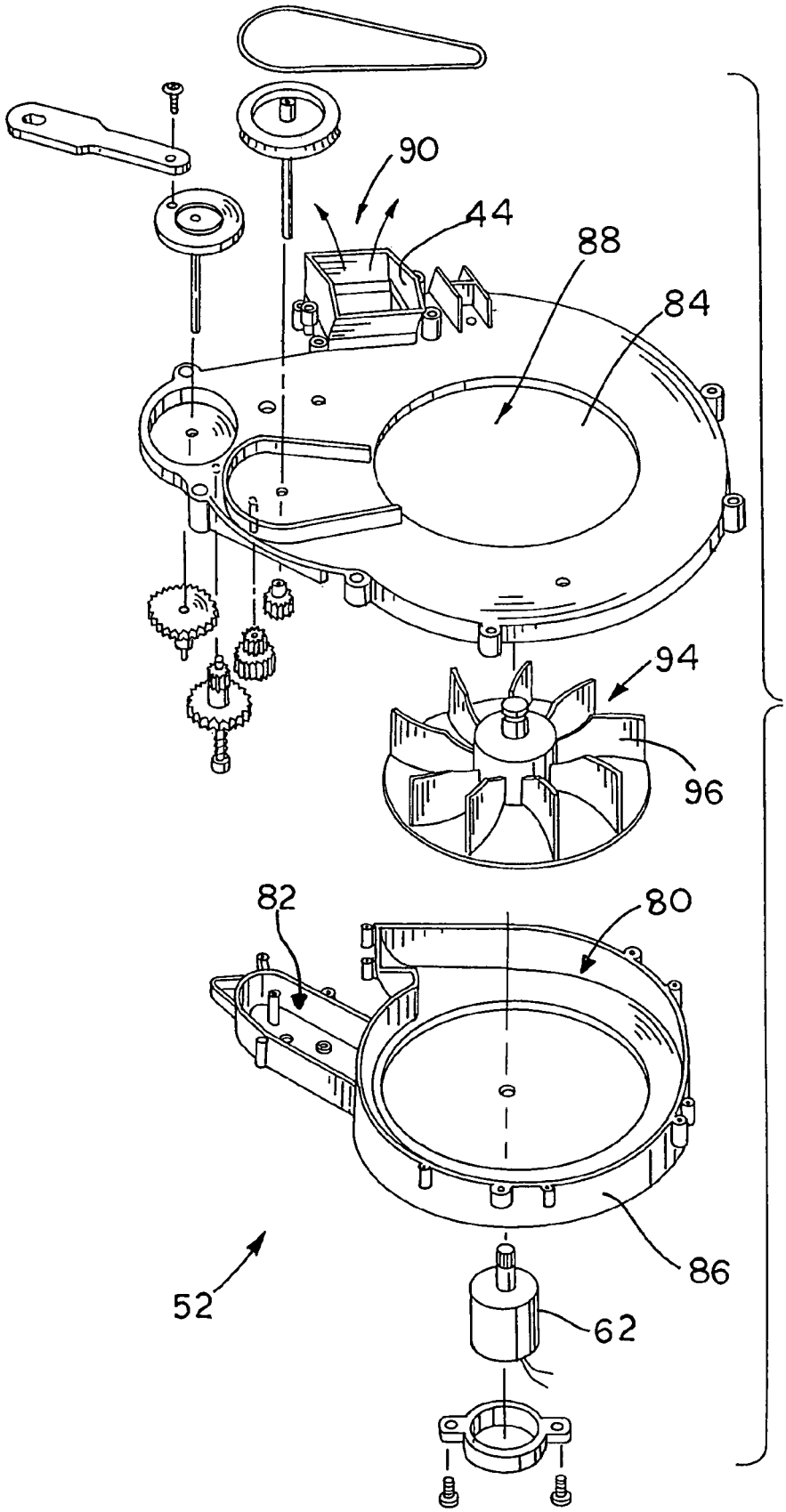
FIG. 4 is an exploded isometric view of a sub-housing of the inflatable toy of FIG. 3.

The sub-housing 52, as seen in FIGS. 3 and 4, includes a blower compartment 80 and drive compartment 82, which each contain at least a portion of the blower mechanism 38 (FIG. 5) and the drive mechanism 50 (FIG. 6), respectively. The sub-housing 52 may be removably attached to the underside of the upper section 23*a* of the housing, and may be attached via fasteners, such as screws, bolts, and the like.

The sub-housing 52, and hence the blower compartment 80 and drive compartment 82, may be manufactured in one or more parts and, in this embodiment, may be constructed from a first or upper portion 84 and a second or lower portion 86, thereby creating upper and lower portions of the blower compartment and upper and lower portions of gear compartment.

Figure 5:
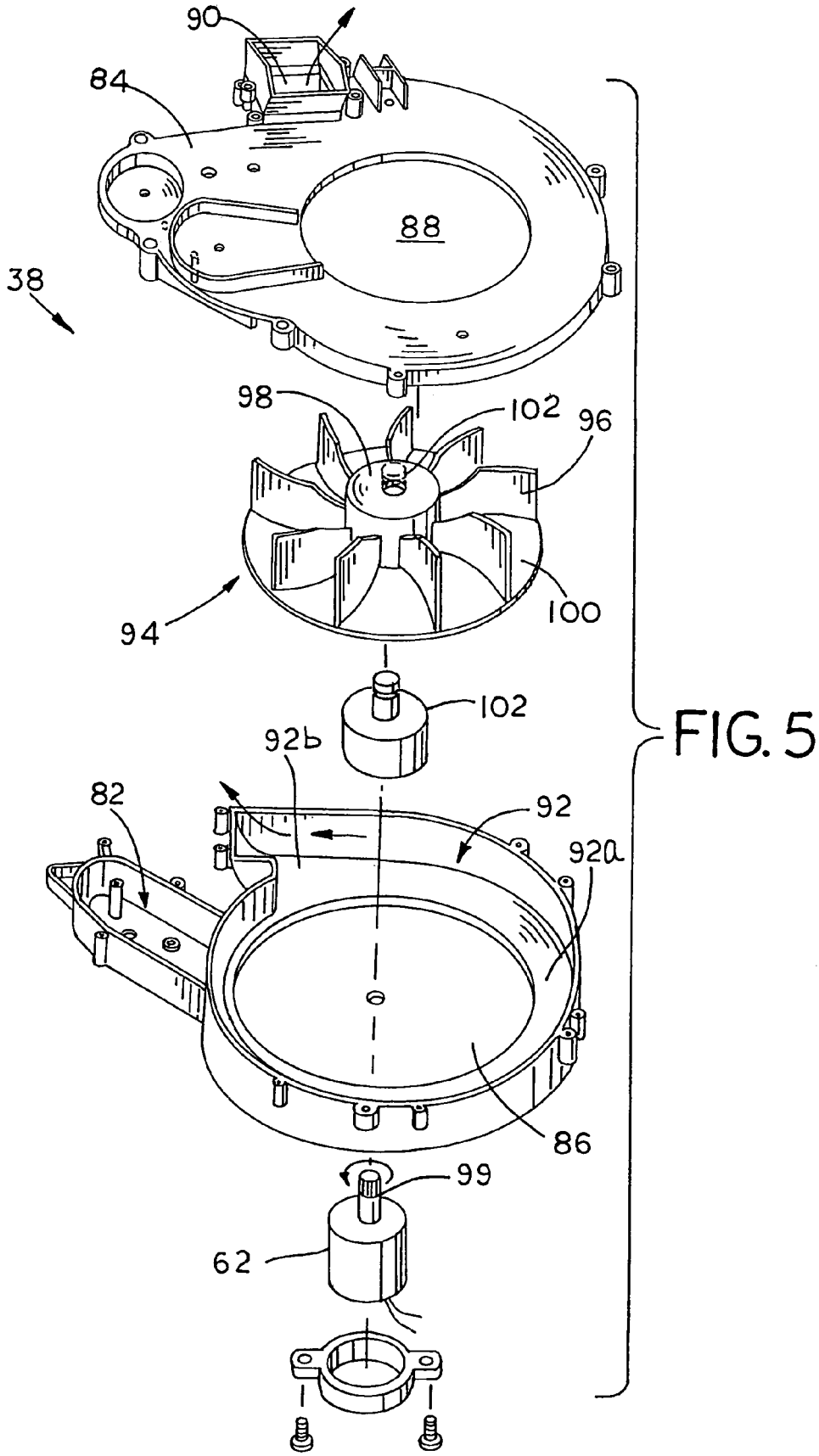
FIG. 5 is a detailed isometric view of a blower mechanism of the inflatable toy of FIG. 4, with partial break out views.

The blower compartment 80 may have a generally circular shape, and may be adapted to receive or house the blower mechanism 38. The blower mechanism 38, as best seen in FIGS. 4 and 5, includes an inlet 88 fluidly connected to an outlet 90, a channel 92, and a fan 94 having a plurality of fan blades 96. The inlet 88, in this exemplary embodiment, is disposed near a center of the sub-housing 52 and, more specifically, near a center of the upper portion of the blower compartment 80. The channel 92 includes a first portion 92*a* disposed around a perimeter of the blower compartment 80, and may have a nautilus-type shape, such that a cross-sectional area of the first portion 92*a* of the channel 92 increases along the direction of the air flow. A second portion 92*b* of the channel 92 is fluidly connected to the first portion 92*a* of the channel, and connects the first portion of the channel 92*a* to the outlet 90. The second portion of the channel 92*b* is oriented tangentially to the first portion of the channel 92*a* and the fan 94. The outlet 90 is disposed near an edge of the sub-housing 52 and, more specifically, is disposed near an edge of the upper portion of the blower compartment 80. The outlet 90 is shaped to correspond and mate with the rim 40 and/or the inlet 34 and, more generally, the sub-housing 52 is disposed in the housing 23 such that the outlet 90 is aligned with the rim 40 and/or the inlet 34.

The fan 94, as seen in FIG. 5, includes the plurality of fan blades 96, a core 98, and a backing plate 100 to which one side of each of the plurality of fan blades 96 is attached. The fan 94 is directly driven by the motor 62, which may be attached to and near a center of the lower portion 86 of the sub-housing 52 or lower section of the blower compartment 80. A shaft 99 of the motor 62 may be disposed within and attached to a center of the core 98 of the fan 94. The fan 94 is oriented in the sub-housing 52 or blower compartment 80, such that the backing plate 100 is disposed opposite the inlet 88. The plurality of fan blades 96 extend radially outward from the core 98, and have a generally curved shape and, more specifically, are shaped such that blades 96 bend away from the direction of rotation of the fan 94. As a result, upon rotation of the fan 94, the fan blades 96 cause air to enter the fan 94 near the core 98, and propel the air into the channel 92 toward the outlet 90, ultimately providing enough air flow discharged from the outlet 90 through the rim 40 of the aperture 34 of the base 30 to inflate the balloon-like structure 20. A first pulley 102 may be axially aligned with and attached to the core 98 opposite the motor 62, such that upon rotation of the fan 94, the first pulley 102 rotates correspondingly.

Figure 6:
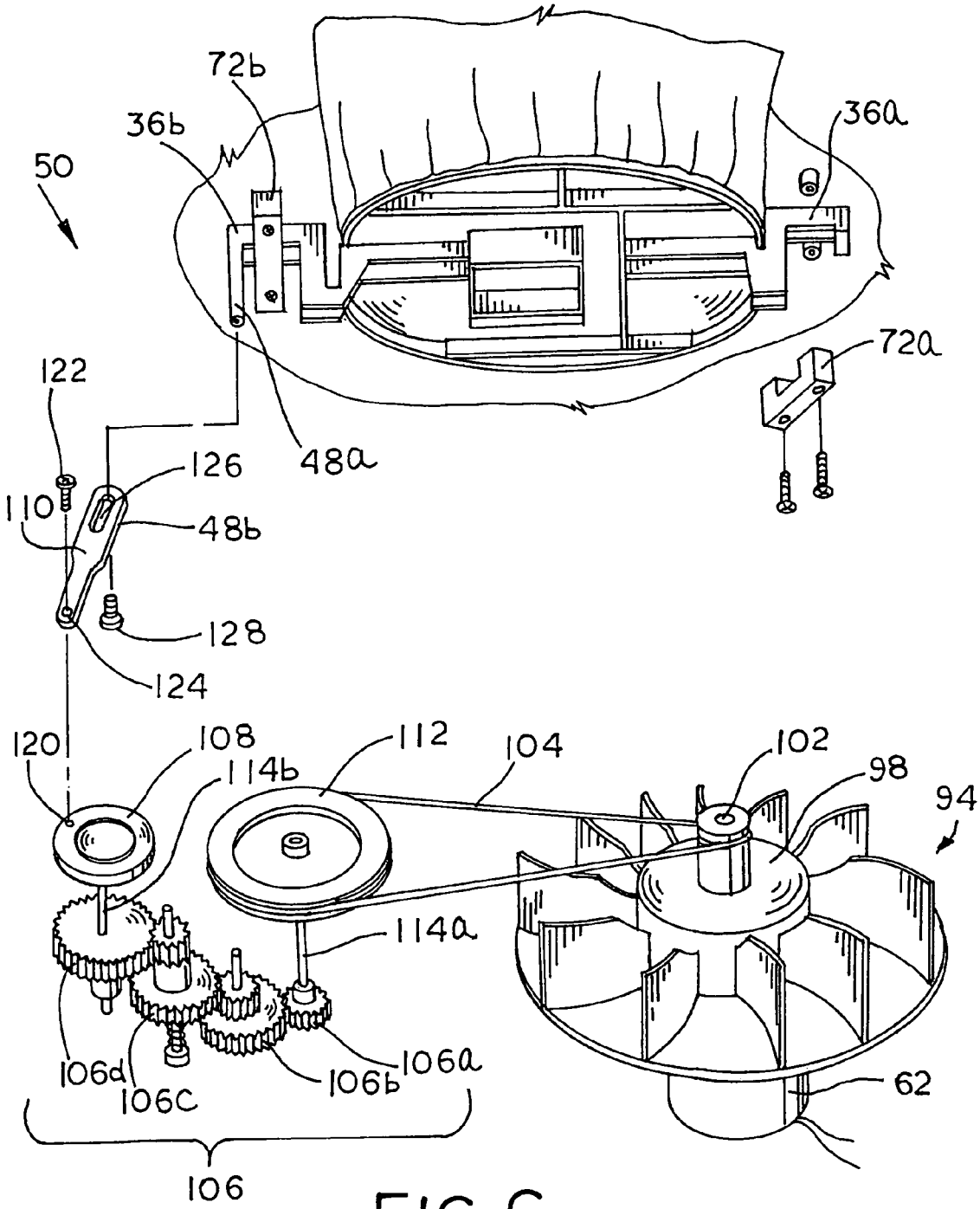
FIG. 6 is a detailed isometric view of a drive mechanism of the inflatable toy of FIG. 4, with partial break out views.

The drive compartment 82 may have a rectangular or odd shape, and may be adapted to receive or house at least part of the drive mechanism 50. The drive mechanism 50, as best seen in FIG. 6, includes a drive belt 104, a plurality of gears 106, a drive disk 108, a drive shaft 110, and may include the first pulley 102 and a second pulley 112. The drive belt 104 may operatively connect the first pulley 102 disposed on the fan 94 to the second pulley 112 disposed on the upper portion of the drive compartment 82. In this exemplary embodiment, the second pulley 112 is larger in diameter than the first pulley 102, thereby causing a rotational speed reduction from the first pulley 102 to the second pulley 112. A center of the second pulley 112 may be attached to a first end of a first shaft 114*a* that extends to an interior of the drive compartment 82 within which a first gear set 106*a* may be attached to a second end of the shaft 114*a*. The first gear set 106*a* may engage and operatively connect to a second gear set 106*b*, which may engage and operatively connect to a third gear concentric set 106*c*. The third gear set 106*c* may engage and operatively connect to a fourth gear set 106*d* that is disposed on a first end of a second shaft 114*b*. The drive disk 108 may be attached to a second end of the second shaft 114*b* and may, like the second pulley 112, be disposed on top of the sub-housing 52 or the drive compartment 82.

The drive disk 108 rotates on the second shaft 114*b* and includes an internally threaded aperture 120 near a perimeter of the drive disk 108. The internally threaded aperture 120 may receive a fastener 122, such as a screw or bolt, that rotatably attaches the drive shaft 110 to the drive disk 108. More specifically, as seen in FIG. 6, a first end of the drive shaft 110 may include an aperture 124 sized and shaped to slidingly receive the fastener 122, such that the drive shaft 110 can freely rotate about the fastener 122 without any undesirable play. As a result, once the fastener 122 is attached to the drive disk 108, the drive shaft 110 is free to rotate relative to the drive disk 108 about the fastener 122. A second end of the drive shaft 110 may include an aperture or slot 126 that may be part of a second portion 48*b* of the connection mechanism 48 that is adapted to connect the base 28 to the drive mechanism 50.

Figure 7:
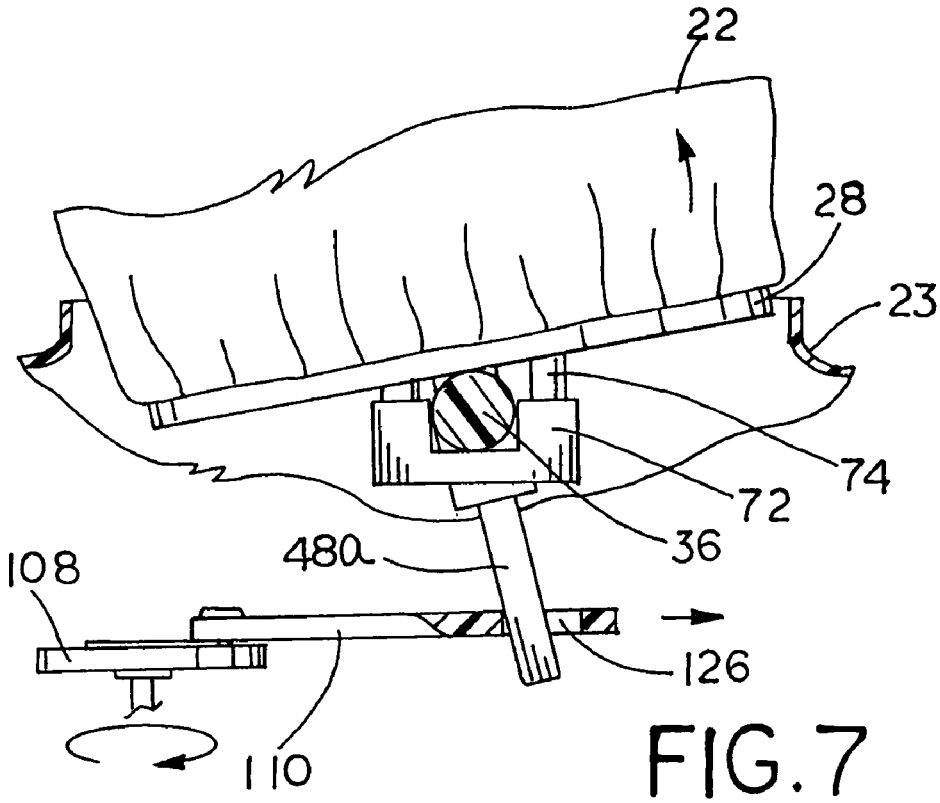
FIG. 7 is a side view of parts of the drive mechanism of FIG. 4.
Figure 8:
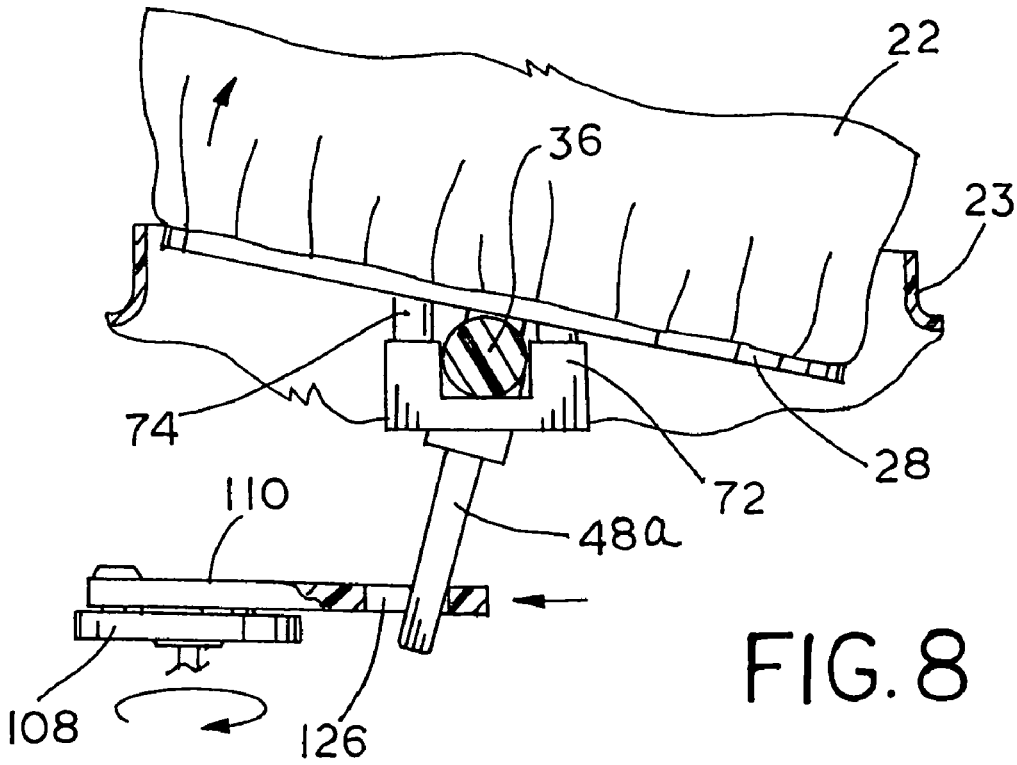
FIG. 8 is the side view of FIG. 7, with the parts in a different opposition.

More specifically, as seen in FIGS. 2 and 6, the internally threaded cylinder 48*a* may be oriented relative to the drive shaft 110 such that a fastener 128 may be inserted through the slot 126 and treaded into the internally threaded cylinder 48*a*. The fastener 128, as such, may slidably engage the slot 126. As a result, once the fastener 128 is attached to the internally threaded cylinder 48*a*, the drive shaft 110 will have a certain degree of freedom relative to the base 28, such that the rotation of the drive disk 108 caused an axial movement on the second end of the drive shaft 110 which then causes the base 28 to pivot about the pair of pivot posts 36. For example, as seen in FIG. 7, the drive disk 108 rotates the drive shaft 110 toward the threaded cylinder 48*a*. As such, the drive disk 108 is rotationally positioned such that the drive shaft 110 extends from the drive disk 108, such that the internally threaded cylinder 48*a* is pushed rightwardly (as oriented in the FIGS. 7 and 8) causing the base 28 to pivot within the housing 23. Similarly, as seen in FIG. 8, the drive disk 108 rotates the drive shaft 110 away from the threaded cylinder 48*a*. As such, the drive disk is rotationally positioned such that the drive shaft 110 is disposed over the drive disk 108, such that the internally threaded cylinder 48*a* is pushed leftwardly causing the base 28 to pivot in the other direction within the housing 23.

The remainder of the mechanical and electronic parts for operating the inflatable toy 20, as seen in FIG. 3, may be connected to or disposed in and to the upper or lower sections of the housing 23. For example, the speaker 25 may be attached to the underside of the upper section 23*a* with one or more fasteners, and the circuit board 54 may be cradled in a plurality of protrusions extending from the upperside of the lower section 23*b* of the housing. The battery compartment 58 may also be disposed on the upperside of the lower section 23*b* of the housing, and may include an openable battery compartment door 130 for inserting or removing a plurality of batteries, which in this example are the power source 56. The vent 60 may be disposed in the upper section 23*a* of the housing, and may be sized and shaped to allow sufficient air flow into the housing 23 and eventually into the blower mechanism 50, and the balloon-like structure 22. The power switch 64 may be disposed on the underside of the lower section 23*b* of the housing and may be a mechanical switch able to connect or disconnect the power source 56 to the inflatable toy 20. The selection switch 68 may similarly be disposed on the underside of the lower section 23*b* of the housing and may be adapted to change the music playing from the speaker 25, and the mode switch 66 may be disposed on the underside of the upper section 23*a* of the housing and may be adapted to turn the inflatable toy 20 on and off. The selection switch 68 may be depressed directly by the user or when the base 23 is rotated, tipped, or rocked toward the selection switch 68 such that the selection switch 68 engages the support surface on which the inflatable toy 20 is disposed. While not fully shown, electrical components may be connected via wires, cables or other appropriate conductors.

The above and other components may be communicably and/or electronically coupled to each other as described below and as seen in a block diagram of FIG. 9. In this exemplary embodiment, the inflatable toy 20 may include a controller 140 containing the movement generation data and sound generation data that may be implemented via circuitry contained on the circuit board 54. The movement and sound generation data may be stored directly on the printed circuit board 54. It should be appreciated that although the controller 140 may be implemented on the printed circuit board 54, more complex implementations of the inflatable toy 20 may be implemented wherein the controller 140 may comprise, among other components, a program memory, a microcontroller or microprocessor (MP), a random-access memory (RAM), read-only memory (ROM), and an input/output (I/O) circuit, all of which may be interconnected. It should be appreciated that the controller 140 may include multiple microprocessors. Similarly, the memory of the controller may include multiple RAMs and multiple program memories, depending on the complexity and requirements of a specific implementation. It should also be appreciated that the I/O circuit may include a number of different types of I/O circuits, such as sound generation circuits, movement generating circuitry, and the like. The RAM(s), ROM(s) and program memories may be implemented as semiconductor memories, magnetically readable memories, and/or optically readable memories, for example.

Figure 9:
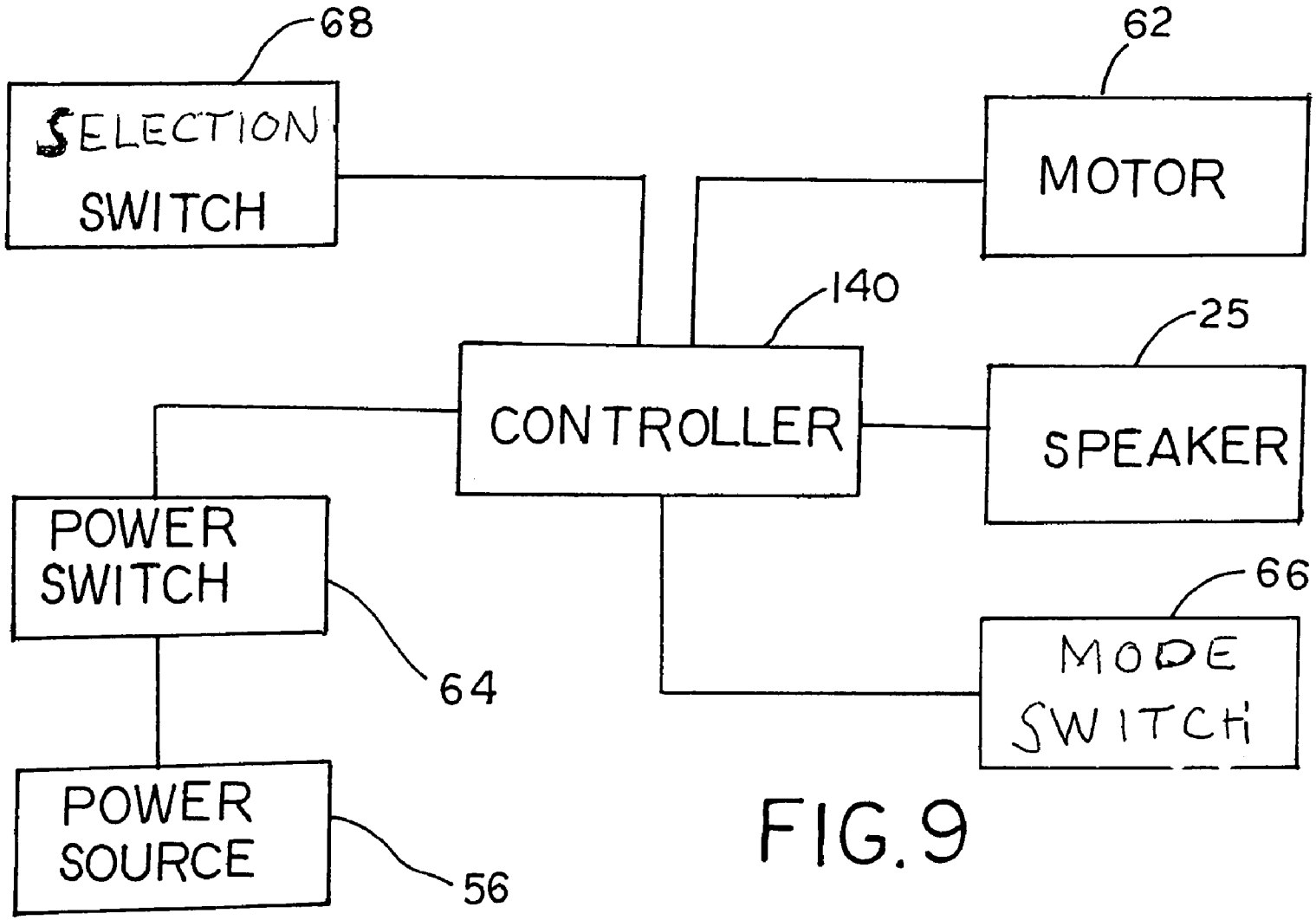
FIG. 9 is a block diagram of the electronic components of the inflatable toy of FIG. 1.

FIG. 9 illustrates that the controller 140 may be operatively coupled to the speaker 25, the power source 56, the motor 62, the power switch 64, the mode switch 66, and the selection switch 68, each of those components being so coupled via a respective direct line or conductor. Different connection schemes could be used. In addition, the power switch 64 may be operatively coupled to a power source 56. When the power switch 64 is in the power-on position, the power source 56 provides power to the circuitry of the controller 140, and the circuitry of the other components. Input signals produced by the switches 66, 68 are output to the controller 140 for processing. Depending on the processing performed, the circuitry of the controller 140 generates and outputs sound generation signals to the speaker 25, wherein the speaker 25 translates the output signals into sounds which can be heard by the individuals near the inflatable toy 20. Similarly, the circuitry of the controller 140 may generate and output current signals to drive the motor 62, wherein the motor 62 translates the output signals into rotational movement, and ultimately into the pivotal movement of the base 28 and the balloon-like structure 22, which can be seen by the individuals near the inflatable toy 20. The general and specific technologies relating to electronic sound and motor activation circuitry, and the software required to run such devices, are well known to those skilled in the electronic and software arts, and therefore the specific details of the digital or analog processing and memory-portions of such circuitry, and the specific details of any software required for this specific application will not be described further herein.

The inflatable toy 20 referenced throughout and the parts thereof may be varied. For example, the inflatable toy 20 may be constructed from a number of materials, including but not limited to plastics, metals, composites, and/or a combination thereof, and in this embodiment may be constructed from a Mylar material. The material may be a textile that is woven or is otherwise constructed, and the material may not be completely airtight, but is able to retain enough air to keep the balloon-like structure 22 filled with air supplied by the blower mechanism 38. The rim 40 may also be disposed on a hemisphere or other shaped structure having an aperture near a bottom for fluidly connecting to the blower mechanism 38. In another example, the various switches described herein, such as the power switch 64, the mode switch 66, and the selection switch 68, may incorporate various types of technologies. For example, the switches may be mechanical or electrical, and may be activated through optical or sound sensors, such as a proximity or light sensor/switch.

The drive assembly, including the blower mechanism 38 and the drive mechanism 50, may also be varied or altered to effectuate the inflation and movement of the balloon-like structure 22. For example, the blower mechanism 38 and the drive mechanism 50 may be actuated separately by one or more motors. As such, the blower mechanism 38 and the drive mechanism 50 may also have separate power switches, mode switches, and the like. Similarly, the structures of the blower mechanism 38 and the drive mechanism 50 may vary. More specifically, the blower mechanism 38 need not include the fan 94 and fan blades 96 as described herein, but may include a variety of air propulsion mechanisms that may be fluidly connected to the balloon-like structure 22 via hoses, tubes, channels, areas, or any other type of fluid connection. The drive mechanism 50 need also not include the gear sets 106, the drive shaft 110, etc. as described in detail above, but may include other structures, which may be more or less complex, able to operatively connect a motor to the balloon-like structure 22. Additionally, the movement of the balloon-like structure 22 is not limited to pivoting about the pivot axis X, as is seen in FIG. 2. For example, the balloon-like structure 22 may pivot about one or more alternate or additional axes about or within the balloon-like structure 22, such that additional or alternate forms of movement may be accomplished.

In operation, the inflatable toy 20 may be utilized to entertain individuals by inflating the balloon-like structure 22, playing music, and pivoting the balloon-like structure 22 attached to the base 28, thereby creating the effect of the balloon-like structure 22 dancing to the music. To provide power to the inflatable toy 20, the user may switch the power switch 64 to the "on" position, thereby providing power to the electrical components of the inflatable toy 20. The user may then activate the mode switch 66, communicably coupled to the controller 140, thereby activating the inflatable toy 20. The controller 140 may then output sound generated signals to activate the speaker 25, thereby causing musical, or other types of audio response to be broadcast by the speaker 25. The controller 140 may also activate the motor 62, thereby causing the blower mechanism 38 to inflate the balloon-like structure 22, and the drive mechanism 50 to pivot the balloon-like structure 22. In this exemplary embodiment, the movement or pivoting of the balloon-like structure 22 may correspond to the music, thereby creating the dancing appearance of the balloon-like structure 22. If the selection switch 68, which is also communicably coupled to the controller 140, is activated, the music or song playing may be changed, altered, and/or added to, as a result, the movement of the balloon-like structure 22 may change.

In one exemplary embodiment, the balloon-like structure 22 may pivot and change according to the rhythm of the music. For example, as the beat of the music changes within the song, or the song changes, such as for example, due to the activation of the selection switch 68, the activation of the mode switch 66, or due to the pre-programmed music or song change as a result of the controller 140, the controller 140 may signal the motor 62 to increase or decrease the rotational speed thereof accordingly, based on the corresponding output signals for driving the motor 62. As a result, the balloon-like structure 22 may pivot at a first rate that corresponds to a first beat of the music and then, as the beat of the music changes the balloon-like structure 22 may pivot at a second rate that corresponds to a second beat.

More specifically, a plurality of sequences may be stored on the controller 140, wherein each sequence includes sound generation information and motor control information. The sound generation information may be a song or musical compilation to be received by the speaker 25, and the motor control information may be a programmed or pre-determined change in the speed of the motor 62. For example, a first sequence may include a first song and a corresponding motor control program that pulses the electric signal to the motor 62 thereby achieving an increase or decrease in motor speed. The controller 140, therefore, using the first sequence may cause the balloon-like structure to dance to the first song. Similarly, a second sequence may include a second song and a corresponding motor control speed. As a result, the controller 140, using the second sequence, may cause the balloon-like structure to dance to the second song.

Additionally, the user may activate the inflatable toy 20 with the mode switch 66, causing the controller 140 to run the first sequence. The user may allow the inflatable toy 20 to run through the entire first sequence without interference at which point the second sequence may start, and so on. The user may, however, deactivate the inflatable toy 20 with the mode switch 66, causing the inflatable toy 20 to deflate and to stop moving. Alternatively, the user or the motion of the inflatable toy 20 may activate the selection switch 68. The activation of the selection switch 68 may cause the controller 140 to output a sound generating signal to the speaker 25, and/or may cause the controller 140 to start another sequence.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

What is claimed is:

1. An inflatable toy, comprising:

a housing;

an inflatable body attached to the housing;

a blower mechanism that provides a flow of fluid and is fluidly connected to the inflatable body;

a drive mechanism operatively connected the inflatable body; and a single motor operatively connected to both the blower mechanism and the drive mechanism, wherein activation of the motor causes the blower mechanism to inflate the inflatable body and causes the drive mechanism to move the inflatable body between a first position and a second position relative to the housing and independently of movement of the inflatable body caused by the flow of fluid.

2. The inflatable toy of claim 1, wherein the inflatable body includes a rigid base pivotally connected to the housing in which is disposed at least a portion of the blower mechanism.

3. The inflatable toy of claim 1, further including a controller programmed to cause the motor to activate.

4. The inflatable toy of claim 1, further including a controller programmed to output sound generation signals to a speaker.

5. The inflatable toy of claim 4, wherein the controller stores a plurality of sound generation signals and wherein the controller outputs a different sound generation signal in response to an actuation switch.

6. The inflatable toy of claim 1, wherein the blower mechanism includes a fan having a plurality of fan blades.

7. The inflatable toy of claim 2, wherein the drive mechanism is operatively connected to the base.

8. The inflatable toy of claim 7, wherein the drive mechanism includes a drive shaft operatively attached to the base at a first end and to a rotating member at a second end.

9. The inflatable toy of claim 1, wherein a shaft of the motor is directly connected to a fan of the blower mechanism.

10. The inflatable toy of claim 7, wherein the drive mechanism is operatively connected to the blower mechanism via a belt.

11. The inflatable toy of claim 2, wherein the housing includes a rounded bottom.

12. An inflatable toy, comprising:

a housing an inflatable figure attached to the housing;

a blower in fluid communication with the inflatable figure;

a drive mechanism operatively coupled to the inflatable figure;

a single motor operatively coupled to both the drive mechanism and the blower;

an input device; and a controller operatively coupled to the input device and the motor;

the controller being programmed to store sound generating information for the inflatable toy, the controller being programmed to detect the actuation of the input device by a user, the controller being programmed to activate the motor in response to detecting the actuation of the input device, wherein activation of the motor causes the blower to provide a flow of fluid to the figure and causes the drive mechanism to move the inflatable figure relative to the housing and independently of movement of the inflatable figure caused by the flow of fluid.

13. The inflatable toy of claim 12, wherein the controller is programmed to pulse an electrical signal to the motor, thereby altering the speed of the motor.

14. The inflatable toy of claim 12, wherein the controller is programmed to output a sound generating signal to a sound generation device in response to detecting the actuation of the input device.

15. The inflatable toy of claim 14, wherein the controller is programmed to cause the motor to move the figure at a speed corresponding to the sound generating signal.

16. A method of operating an inflatable toy, comprising:

operatively coupling a single motor to both a drive mechanism and a blower mechanism;

operatively coupling the drive mechanism to an inflatable body attached to a housing;

fluidly connecting the blower mechanism to the inflatable body; and actuating the motor to cause the blower mechanism to inflate the inflatable body and to cause the drive mechanism to move the inflatable body between a first position and a second position relative to the housing, wherein the movement of the inflatable body caused by the drive mechanism is independent from movement of the inflatable body caused by a flow of fluid provided by the blower mechanism.

17. The method of operating an inflatable toy of claim 16, further including generating sounds at a speaker of the toy when the motor is actuated.

18. The method of operating an inflatable toy of claim 17, further including actuating the motor at a first speed when a first set of sounds are generated, and actuating the motor at a second speed when a second set of sounds are generated.

19. The method of operating an inflatable toy of claim 18, further including automatically switching from the first speed and set of sounds to the second speed and set of sounds.

20. The method of operating an inflatable toy of claim 18, further including switching from the first speed and set of sounds to the second speed and set of sounds in response to actuation of an input device.

21. An inflatable toy, comprising:

a housing;

an inflatable body relative to the housing and; and a drive assembly operatively and fluidly connected to the inflatable body to inflate the inflatable body and to move the inflatable body relative to the housing and in a manner that is independent from movement of the inflatable body caused by a flow of fluid provided by the drive assembly, wherein the drive assembly comprises a single motor, and wherein the drive assembly comprises a blower mechanism fluidly connected to the inflatable body to inflate the inflatable body and a drive mechanism operatively connected to the inflatable body to move the inflatable body independent of movement caused by the flow of fluid to the inflatable body from the blower mechanism.

22. The inflatable toy of claim 21, wherein the drive assembly moves the inflatable body from a first to a second position.

23. The inflatable toy of claim 21, wherein the inflatable body includes a base pivotally connected to a housing in which is disposed at least a portion of the drive assembly.

* * * * *

UNITED STATES PATENT AND TRADEMARK OFFICE

CERTIFICATE OF CORRECTION

PATENT NO. : 7,356,951 B2
APPLICATION NO. : 11/032912
DATED : April 15, 2008
INVENTOR(S) : Lee Spielberger et al.

It is certified that error appears in the above-identified patent and that said Letters Patent is hereby corrected as shown below:

At Column 10, line 38, “housing” should be -- housing; --.

At Column 12, line 7, “relative to the housing and; and” should be -- attached to the housing; and --.

Signed and Sealed this

Twenty-fourth Day of February, 2009

JOHN DOLL
*Acting Director of the United States Patent and Trademark Office*